US006618865B1

(12) United States Patent
Kim

(10) Patent No.: US 6,618,865 B1
(45) Date of Patent: Sep. 16, 2003

(54) BIDET WITH SEPARATE UNITS FOR WASHING THE ANAL REGION, PUDENDAL REGION AND ORAL CAVITY

(76) Inventor: Ki-Chul Kim, 44-7 406, Ho, Chungdarm-dong, Gangnam-ku, Seoul (KR), 135-100

( * ) Notice: Subject to any disclaimer, the term of this patent is extended or adjusted under 35 U.S.C. 154(b) by 0 days.

(21) Appl. No.: 09/403,670

(22) PCT Filed: Apr. 25, 1998

(86) PCT No.: PCT/KR98/00100

§ 371 (c)(1),
(2), (4) Date: Jan. 10, 2001

(87) PCT Pub. No.: WO98/49402

PCT Pub. Date: Nov. 5, 1998

(30) Foreign Application Priority Data

Apr. 28, 1997 (KR) ..... 97/15996

(51) Int. Cl.[7] ..... E03D 9/08
(52) U.S. Cl. ..... 4/420.4
(58) Field of Search ..... 4/420, 1–420.5, 4/443–448

(56) References Cited

U.S. PATENT DOCUMENTS 5,647,069 A * 7/1997 Han et al. ..... 4/420.2
5,937,451 A * 8/1999 Mihara ..... 4/448
6,167,577 B1 * 1/2001 Hammad ..... 4/420.4

* cited by examiner

*Primary Examiner*—Charles E. Phillips

(57) ABSTRACT

A bidet, with separate units for washing one's anal region, pudendal region and oral cavity, is disclosed. In the bidet, a control box is attached to a side portion of a toilet bowl and is used for controlling the bidet. An anal washing unit is positioned inside a rear portion of the toilet bowl and is connected to the control box. A hand-operated pudendal washing unit is movably held on the front portion of the control box and is connected to the control box through a hose. A hand-operated mouth washing unit is connected to the control box through a hose capable of allowing the mouth washing unit to reach a desired position remote from the toilet bowl. The bidet is selectively used with a conventional electric hot-water supply system or existing hot and cold water supply pipes installed in a toilet.

14 Claims, 10 Drawing Sheets

BIDET WITH SEPARATE UNITS FOR WASHING THE ANAL REGION, PUDENDAL REGION AND ORAL CAVITY

TECHNICAL FIELD

The present invention relates, in general, to bidets used for washing one's bottom and sex organs and, more particularly, to a bidet provided with separate units for washing one's anal region, pudendal region and oral cavity and selectively used with a conventional electric hot-water supply system or existing hot and cold water supply pipes installed in a toilet, thus allowing a person to selectively wash the anal region, pudendal region and oral cavity while controlling the pressure and temperature of the water jet from the separate washing units.

BACKGROUND ART

As well known to those skilled in the art, several types of bidets and their accessories are proposed and used. For example, Korean U.M. Laid-open Publication No. 96-7783 discloses a bidet capable of supplying warm water without having any external electric power source. Korean U.M. Publication No. 96-10621 discloses a water flow control device for bidets with a solenoid valve being provided at the coupling of pipes for separate anal and pudendal washing nozzles. Korean U.M. Publication No. 96-25 discloses a nozzle assembly for bidets with a self-cleaning means for automatically flushing the nozzles of a bidet at the beginning and ending of an washing operation of the bidet. Korean U.M. Laid-open Publication No. 96-11293 discloses a nozzle device for bidets with a rack and pinion mechanism capable of selectively moving one washing nozzle. Korean U.M. Laid-open Publication No. 96-5258 discloses a toilet bowl seat with a pudendal washing nozzle being interiorly fixed at the front portion of a toilet bowl. Korean U.M. Publication No. 94-7731 discloses a bidet for toilet bowls with one nozzle capable of selectively washing one's anal or pudendal region.

However, the known bidets and their accessories have the following problems.

First, it is necessary for women to wash the anal and pudendal regions after every excretion. However, in the known bidets, one movable washing nozzle, provided at the rear portion of a toilet bowl, moves forward and backward within a predetermined range so as to upwardly eject pressurized water onto the anal and pudendal regions, so the nozzle regrettably fails to precisely eject water onto the anal or pudendal region, thus reducing the anal or pudendal washing effect and causing a hygienic problem. In an effort to solve the problem, a toilet bowl seat, with a pudendal washing nozzle being interiorly and fixedly positioned at the front portion of a toilet bowl, is proposed as disclosed in Korean U.M. Laid-open Publication No. 96-5258. However, the problem experienced in the above toilet bowl seat is that the position of the pudendal washing nozzle is not adjustable but is fixed, thus failing to appropriately meet different positions of user's pudendal regions.

Second, the known nozzle assemblies, used for washing the anal region, are typically designed for moving forward and backward by electric force, thus being necessarily provided with an electric power supply device. However, such an electric power supply device complicates the process of installing the bidets and may cause a short circuit. Another problem of such nozzle assemblies resides in that the nozzles have to be periodically washed, otherwise they may easily malfunction.

Third, the known bidet, disclosed in Korean U.M. Laid-open Publication No. 96-17783, is designed for ejecting pressurized water, supplied from existing hot and cold water supply pipes already installed in a toilet, through nozzles with the temperature of warm water being controlled by a warm water controller without using any external electric power. The above bidet has a simple construction, thus being easily installed in a toilet. However, in the above bidet, the pressure and temperature of water are commonly controlled by one warm water controller, so the pressure and temperature of water are easily changeable, thus making the bidet inconvenient to users in practical use.

Fourth, the known bidets are also problematic in that they are exclusively used for washing one's anal and pudendal regions.

DISCLOSURE OF THE INVENTION

Accordingly, the present invention has been made with the above problems occurring in the prior art in mind, and the primary object of the present invention is to provide a bidet, which is provided with separate units for washing one's anal region, pudendal region and oral cavity and allows a user to selectively wash the anal region, pudendal region and oral cavity using water from existing hot and cold water supply pipes installed in a toilet while appropriately controlling the pressure and temperature of the water jet from the separate washing units without using any external electric power source.

The second object of the present invention is to provide a bidet, of which the anal washing nozzle is fixed at the rear portion of a toilet bowl and is designed for being opened or closed by the pressure of water without using any external electricity, thus being almost free from breakage and improving durability, and lengthening the expected life span of the bidet.

The third object of the present invention is to provide a bidet, of which both units for washing one's pudendal region and oral cavity are not fixed but are movable by a user, thus being commonly usable by many people, and the handles of the pudendal and mouth washing units are designed in accordance with human technology, thus allowing a user to easily use the units without overstraining one's hand and being convenient to users.

The fourth object of the present invention is to provide a bidet, of which the control box and the anal washing nozzle are designed for being detachably held on a toilet bowl, thus being easily installed on an existing toilet bowl and being easily changeable with a new one.

The fifth object of the present invention is to provide a bidet, which has a changeable filter installed at the pipe connector of the hot and cold water hoses, thus effectively filtering off impurities from water supplied from existing hot and cold water supply pipes and almost completely preventing any breakage due to such impurities, and lengthening the expected life span of the bidet.

The sixth object of the present invention is to provide a bidet, of which the temperature control valve and the flow control valve, both being included in the control box, are positioned in a way such that a user easily reaches and operates the two valves.

In order to accomplish the above objects, a bidet according to the present invention comprises: a control box attached to a side portion of a toilet bowl and used for controlling the bidet; an anal washing unit positioned inside a rear portion of the toilet bowl and connected to the control box; a hand-operated pudendal washing unit movably held on a front portion of the control box and connected to the control box through a hose; and a hand-operated mouth washing unit connected to the control box through a hose capable of allowing the mouth washing unit to reach a desired position remote from the toilet bowl.

BRIEF DESCRIPTION OF THE DRAWINGS

The above object, and other features and advantages of the present invention will be more clearly understood from the following detailed description taken in conjunction with the accompanying drawings, in which:

FIGS. 8 to 11 are sectional views showing the construction and operation of the above anal washing nozzle, in which: FIGS. 8 and 10 are individually taken in the direction "C" of FIG. 7, and FIGS. 9 and 11 are individually taken in the direction "B" of FIG. 7;

BEST MODE FOR CARRYING OUT THE INVENTION

Figure 1:
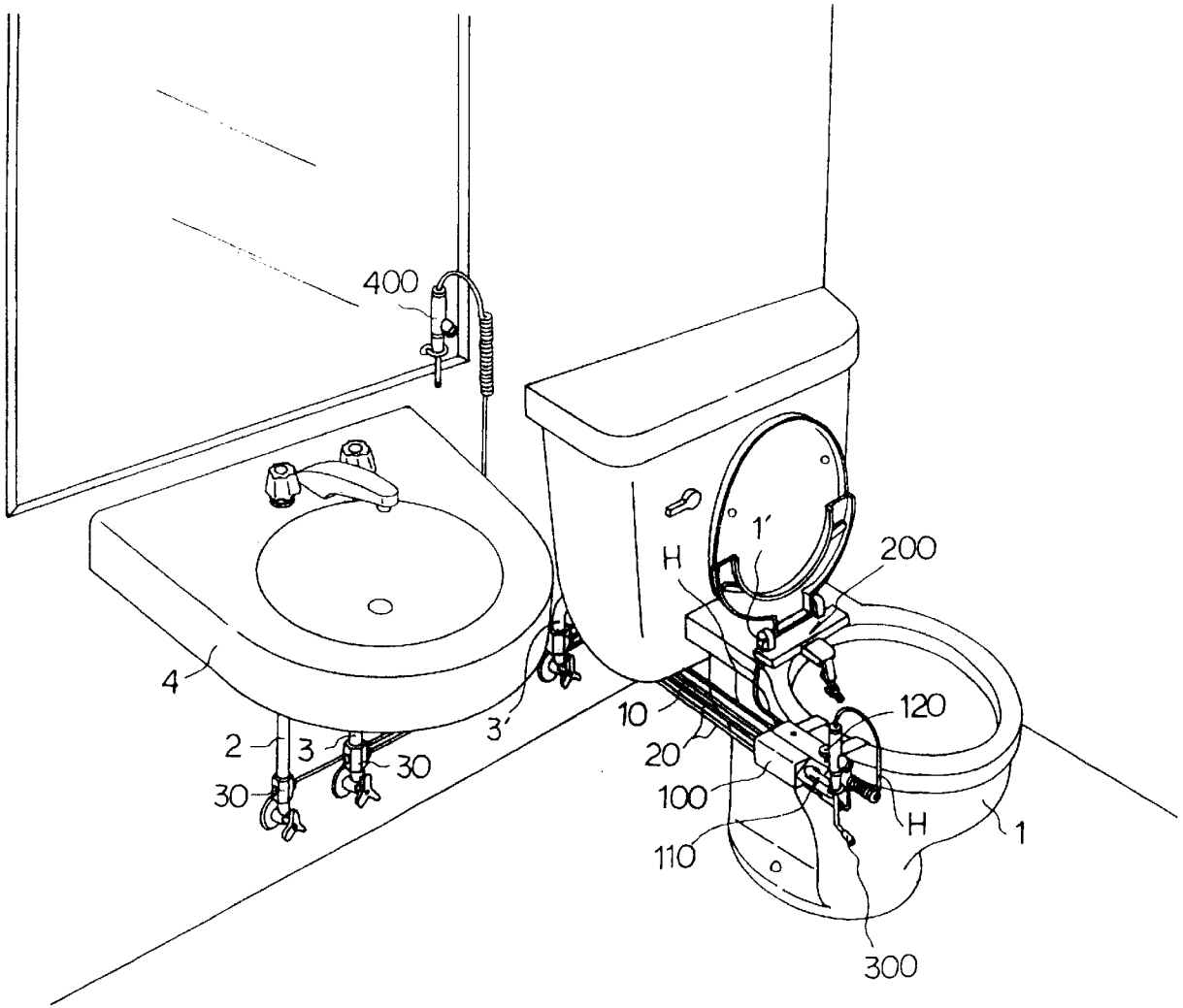
FIG. 1 is a perspective view showing the construction of a bidet in accordance with the primary embodiment of the present invention.

FIG. 1 is a perspective view showing the construction of a bidet in accordance with the primary embodiment of this invention. Of course, the bidet of this invention may be used with a conventional electric hot-water supply system or existing hot and cold water supply pipes installed in a toilet. However, for ease of description, the bidet of this invention will be used with existing hot and cold water supply pipes in the following embodiments.

As shown in FIG. 1, the bidet according to the primary embodiment comprises a control box 100, an anal washing unit 200, a pudendal washing unit 300 and a mouth washing unit 400. The control box 100 is exteriorly attached to a side portion of the top edge of a toilet bowl 1. The anal washing unit 200 is fixedly positioned inside the rear end of the bowl 1. The pudendal washing unit 300 is movably held on the front portion of the control box 100 in a way such that the unit 300 is hand-operated by a user when necessary. Meanwhile, the mouth washing unit 400 has a flexible hose which allows the unit 400 to reach a position around a washing stand 4. The mouth washing unit 400 is movably held at the side of the washing stand 4, so the unit 400 is hand-operated by a user when necessary.

The control box 100 is connected to existing hot and cold water supply pipes 2 and 3 in a toilet through hot and cold water supply hoses 10 and 20, respectively. In the control box 100, hot and cold water from the two pipes 2 and 3 are mixed together under the control of a temperature control valve 110 prior to being supplied to the separate units 200, 300 and 400 tinder the control of a flow control valve 120.

Figure 2:
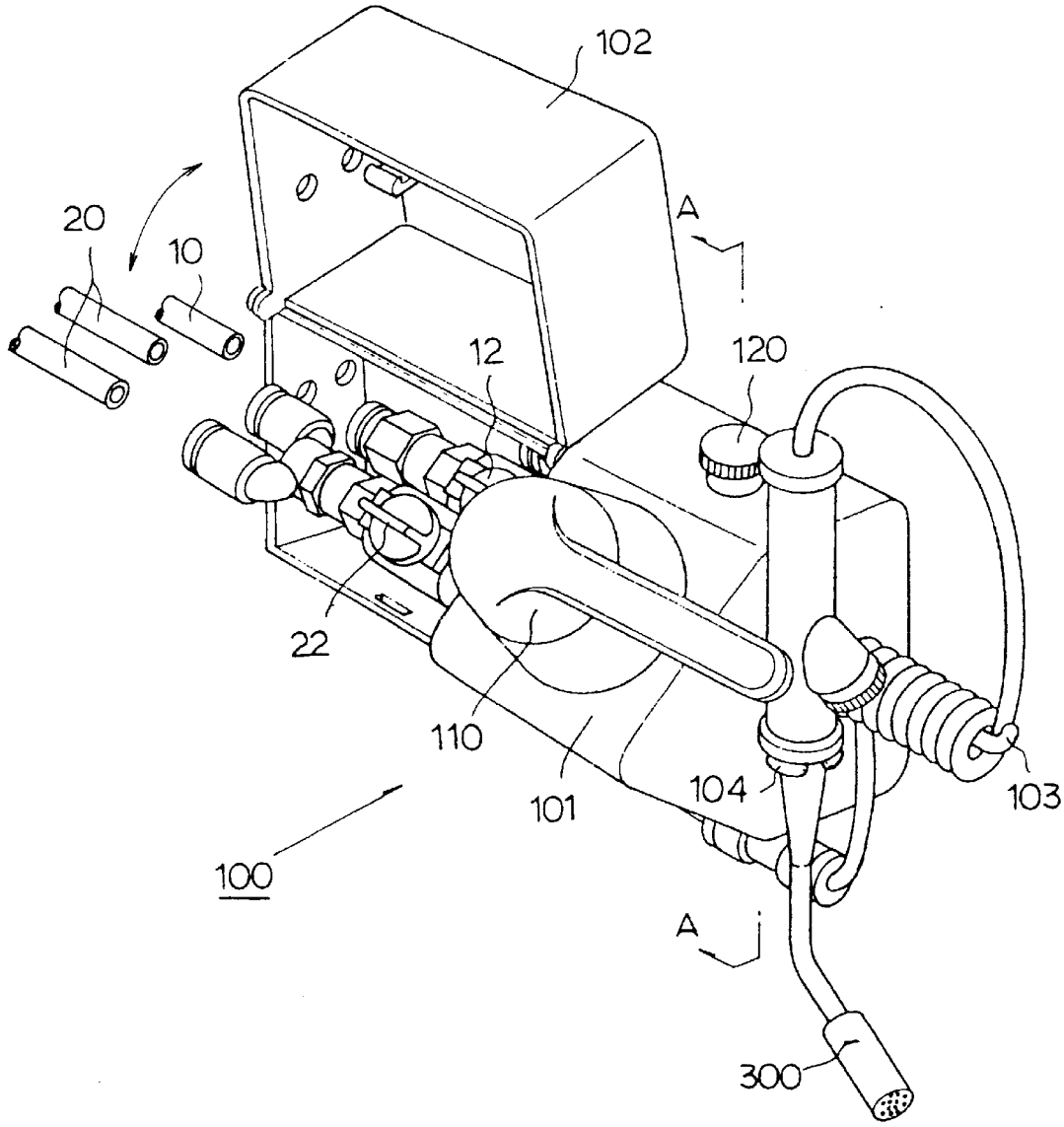
FIG. 2 is a perspective view showing the construction of a control box included in the above bidet.

FIG. 2 is a perspective view showing the construction of the control box 1. As shown in the drawing, the control box 100 comprises hot and cold water control valves 12 and 22 which are respectively mounted to the hot and cold water supply hoses 10 and 20 extending to the inside of a housing 101. The temperature control valve 110 is connected to the outlet ends of the hot and cold water control valves 12 and 22, thus controlling the water temperature by mixing hot and cold water from the two valves 12 and 22. Meanwhile, the flow control valve 120 is connected to the outlet end of the temperature control valve 110.

The rear portion of the control box 100 has a rectangular cross-section, thus forming a cavity suitable for accommodating the hot and cold water control valves 19 and 22. Meanwhile, the front portion of the control box 100 has a pentagonal cross-section, thus effectively holding the temperature control valve 110 at a position inclined outwardly and downwardly at an angle of about 30°~45°. The front end of the control box 100 has two hangers: a longitudinal hanger 103 and an annular hanger 104, used for hanging the pudendal washing unit 300.

The hot and cold water control valves 12 and 22 primarily control the amount of hot and cold water from the hot and cold water supply pipes 2 and 3. The housing 101 of the control box has an openable cover 102 at a position around the two valves 12 and 22, thus allowing a user to reach the valves 12 and 22 in order to appropriately control the pressure of hot and cold water.

When the cold water supply pipe 3 supplies highly pressurized cold water, the cold water control valve 22 may be connected to one cold water supply hose 20. However, when the cold water supply pipe 3 supplies lowly pressurized cold water, it is necessary to connect two cold water supply hoses 20 to the control valve 22 so as to increase the cold water pressure. Therefore, the cold water control valve 22 has two taps through which the valve 22 is connected to the two cold water supply pipes 3 and 3' for the washing stand 4 and toilet bowl 1. In such a case, it is possible to open the two pipes 3 and 3' or open either of the two pipes 3 and 3' while closing the other pipe.

Figure 3:
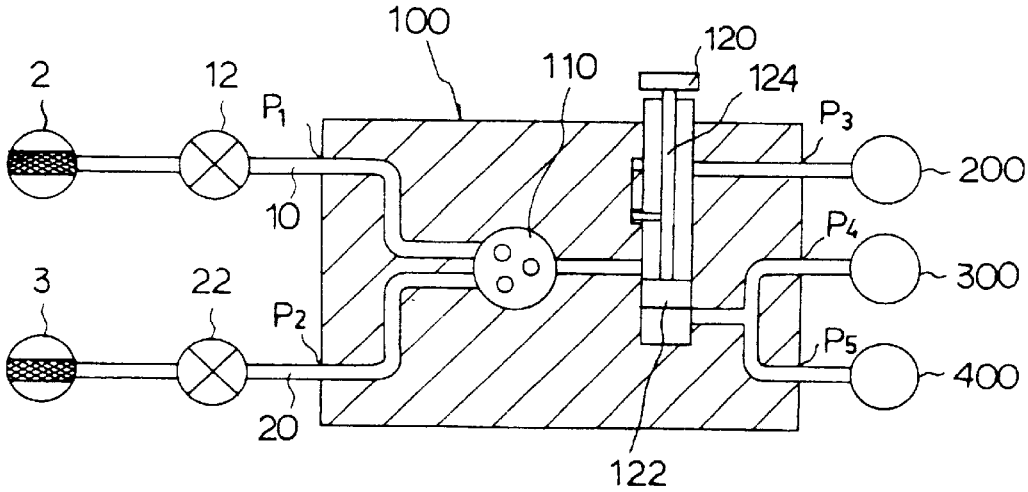
FIG. 3 is a sectional view showing a pipe arrangement for the bidet of this invention.

FIG. 3 is a sectional view showing a pipe arrangement for the bidet of this invention. As shown in the drawing, the housing 101 of the control box 100 has two inlet ports P1 and P2 for the hot and cold water control valves 12 and 22 and three outlet ports P3, P4 and P5 for the three separate units 200, 300 and 400. The three outlet ports P3 to P5 are designed in a way such that water, outlet from the temperature control valve 110 under the control of the push/pull-type flow control valve 120, may be selectively guided to the first outlet port P3 for the anal washing unit 200 or the second and third outlet ports P4 and P5 for the pudendal and mouth washing units 300 and 400. Therefore, hot and cold water from the valves 12 and 22 are mixed together in the temperature control valve 110, thus forming mixed water. The mixed water is, thereafter, selectively supplied to the port P3 for the anal washing unit 200 or the ports P4 and P5 for the pudendal and mouth washing units 300 and 400 under the control of the flow control valve 120.

Figure 4:
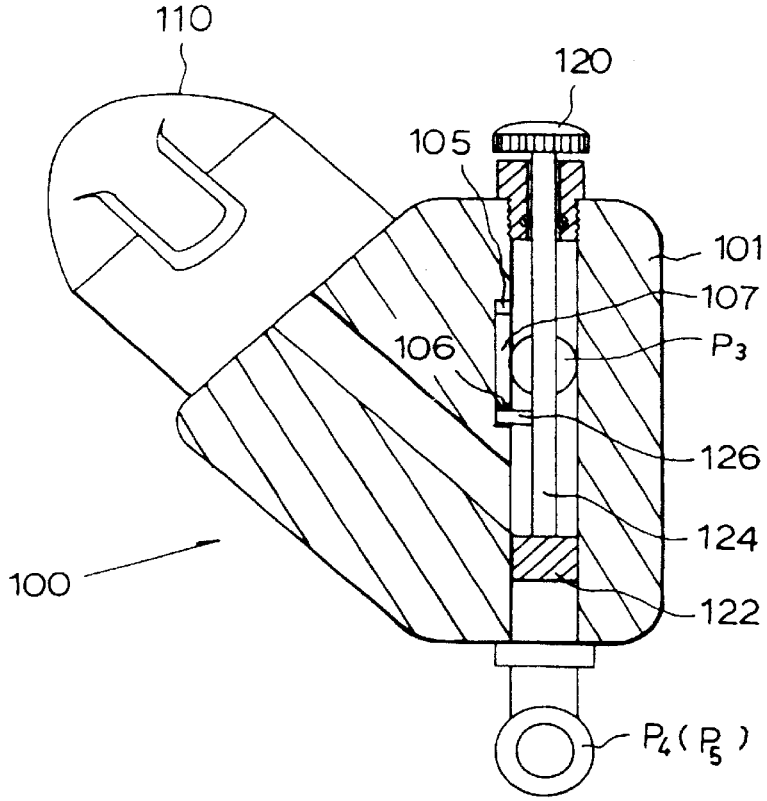
FIG. 4 is a cross sectional view of line A—A of FIG. 2 showing the construction of a flow control valve included in the above bidet.

FIG. 4 is a sectional view showing the construction of the flow control valve 120. As shown in the drawing, the flow control valve 120 comprises a longitudinal valve rod 124, which is movably set in a valve hole of the housing 101 and has a hand-operated knob 120 at the outside of the housing 101. An actuating protrusion 126 is radially outwardly formed on the rod 124 inside the housing 101, while a guide slot 107 is formed on the valve hole of the housing 101. The guide slot 107 has upper and lower inclined seats 105 and 106 which selectively seat and hold the actuating protrusion 126 of the valve rod 124.

Figure 5:
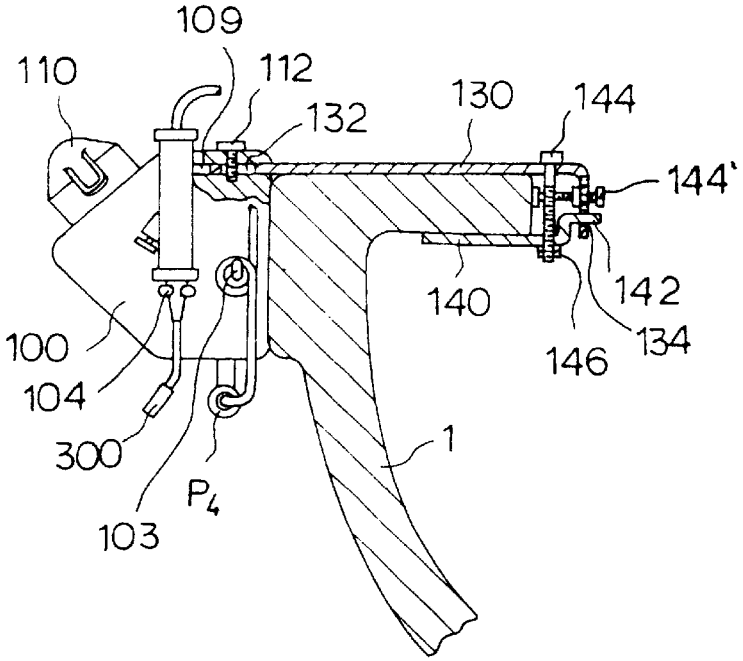
FIG. 5 is a partially sectioned view showing the control box installed on the top edge of a toilet bowl.

FIG. 5 is a partially sectioned view showing the control box 100 installed on the top edge of the toilet bowl 1. As shown in the drawing, the toilet bowl 1 has a wide top edge, while the control box 100 is installed on the top edge of the toilet bowl 1 using two bracket members, thus being positioned outside the bowl's side wall. The two bracket members individually comprise outside and inside brackets 130 and 140. In each of the two pairs of bracket members, the outside bracket 130, having an L-shaped cross-section, is laid across the wide top edge of the bowl 1 and is inserted into a bracket hole 109, formed on the upper portion of a side wall of the control box 100, at the end of its horizontal part prior to being screwed to the control box 100 using a set bolt 112. The horizontal part of the outside bracket 130 is provided with a longitudinal hole 132 for allowing a user to adjust the horizontal length of the bracket 130 in accordance with a width of the wide top edge of the bowl 1. Meanwhile, the vertical part of the outside bracket 130 has a plurality of holes 134 at regularly spaced positions along the length of the vertical part, thus allowing the bracket 130 to be coupled to the inside bracket 140 regardless of the thickness of the bowl's wide top edge.

The inside bracket 140 is closely positioned under the top edge of the bowl 1 and is coupled to the vertical part of the outside bracket 130. The inside bracket 140 has an insert part 142, which is selectively inserted into one of the holes 134 of the outside bracket 130 in accordance with the thickness of the wide top edge of the bowl 1. The two brackets 130 and 140 are tightened to each other using a bolt 144, which vertically passes through the two brackets 130 and 140 at the inside of the bowl 1 prior being tightened by a nut 146. Due to the two bracket members, the control box 100 is firmly installed on the toilet bowl 1. A set bolt 144' passes through one of the holes 134 of the outside bracket 130 and is fully tightened against the inside surface of the bowl's top edge, thus firmly holding the control box 100 on the bowl 1.

Figure 6:
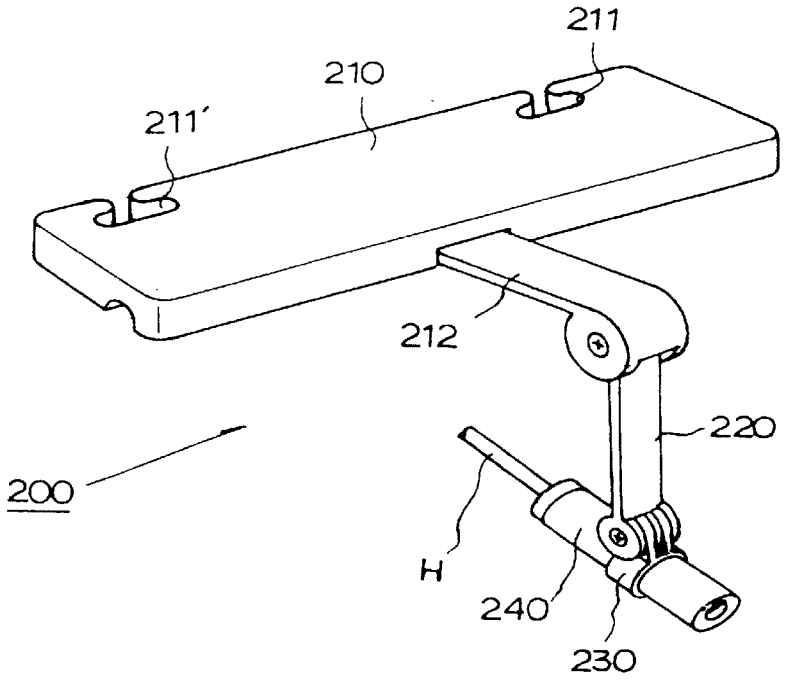
FIG. 6 is a perspective view showing the construction of an anal washing unit of the above bidet.

FIG. 6 is a perspective view showing the construction of the anal washing unit 200. As shown in the drawing, the anal washing unit 200 comprises an anal washing nozzle 240 held on the rear portion of the bowl 1 by a nozzle bracket. The anal nozzle bracket comprises an upper mount panel 210, a link 220 and an annular nozzle holder 230. The upper mount panel 210 has two fitting cutouts 211 and 211' at the rear edge and a length adjustable connecting arm 212 at the center of the front edge. The two fitting cutouts 211 and 211' have a T-shaped profile and are mounted to the rear portion of the bowl 1, thus holding the panel 210 to the bowl 1, while the connecting arm 212 is movably fitted into the center of the panel's front edge, thus being adjustable in the length. The link 220 is jointed to the outside end of the connecting arm 212 at a first joint, thus being rotatable around the first joint. The nozzle holder 230, used for holding the anal washing nozzle 240, is jointed to the outside end of the link 220 at a second joint, thus being rotatable around the second joint.

Due to the specifically designed fitting cutouts 211 and 211', the upper mount panel 210 is easily attached to or removed from the set bolts 1' of a seat without loosening the bolts 1'.

Figure 7:
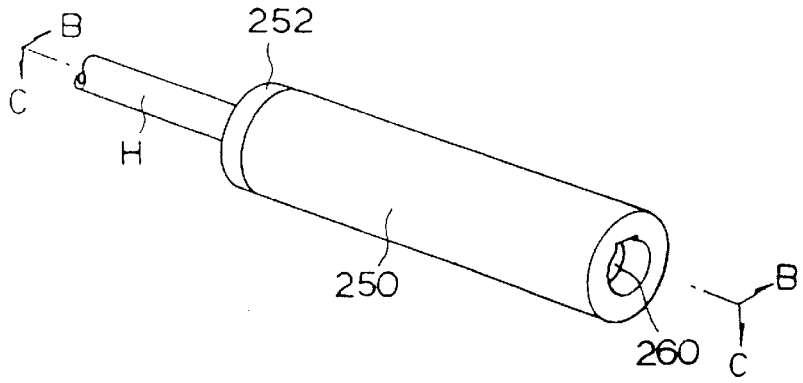
FIG. 7 is a perspective view of an anal washing nozzle of the above anal washing unit.
Figure 8:
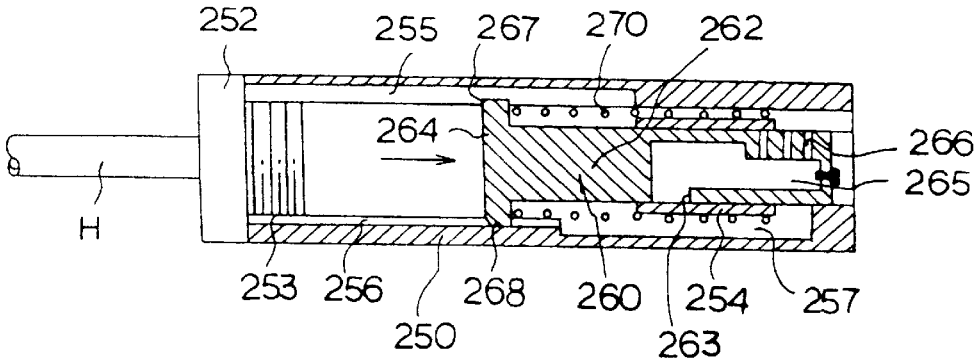
Figure 9:
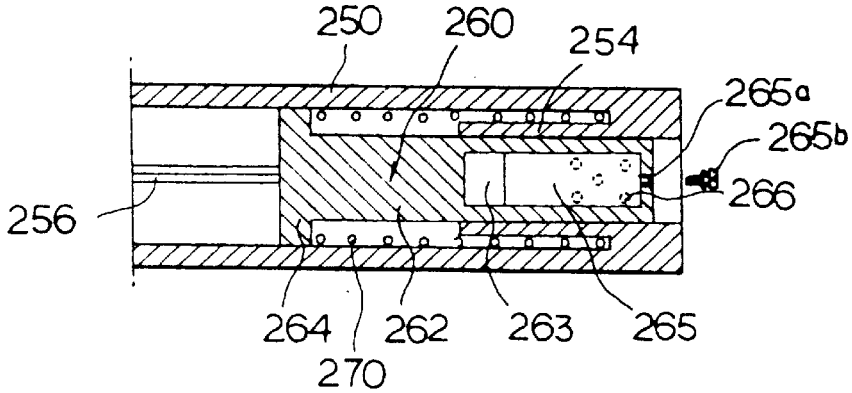
Figure 10:
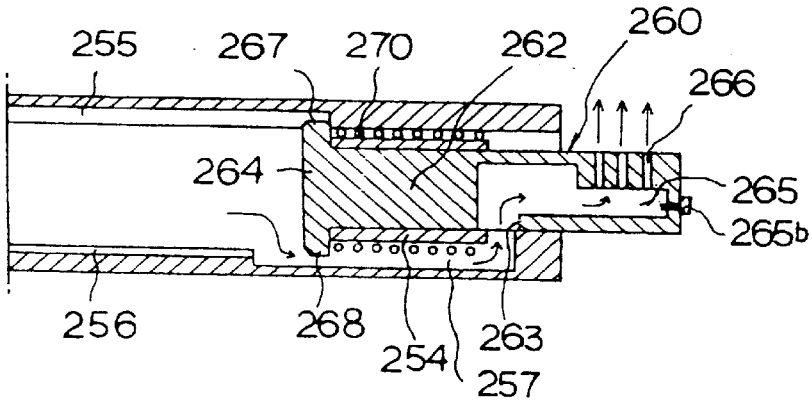
Figure 11:
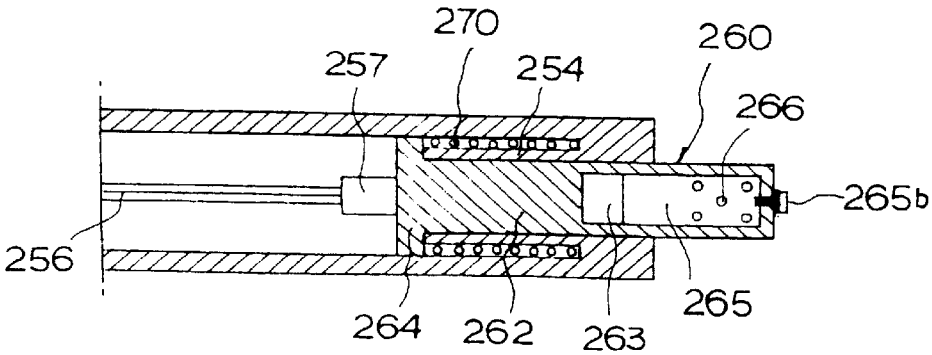

FIG. 7 is a perspective view of the anal washing nozzle 240. FIGS. 8 to 11 are sectional views showing the construction and operation of the anal washing nozzle 240, in which FIGS. 8 and 10 are individually taken in the direction "C" of FIG. 7, while FIGS. 9 and 11 are individually taken in the direction "B" of FIG. 7. As shown in the drawings, the anal washing nozzle 240 comprises a sleeve 250 and a plunger 260. The inlet end of the sleeve 250 is closed by a screw plug 252 which is connected to a hose "H". The plunger 260 is received in the sleeve 250 in a way such that the outside end of the plunger 260 projects from or retracts into the sleeve 260 in accordance with the pressure acting on the inside end.

That is, the plunger 260 of the anal washing nozzle 240 is axially received in the sleeve 250, with a compression coil spring 270 being positioned between the sleeve 250 and the plunger 260 so as to normally bias the plunger 260 in a retracting direction as shown in FIGS. 7 to 11.

The rear portion of the sleeve 250 has an internal thread 253 which engages with the external thread of the screw plug 252, while the front portion has an internal sleeve part 254 with a gap being formed outside the internal sleeve part 254. The compression coil spring 270 is fitted over the internal sleeve part 254, while the plunger 260 is movably fitted into the sleeve part 254. The above sleeve 250 also has two axial guide grooves 255 and 256 at the upper and lower internal surfaces of the rear portion and an axial water guide groove 257 at the lower internal surface of the front portion.

The plunger 260, received in the sleeve 250, consists of a cylindrical body 262, which has a flange 264 at the rear end and has an outer diameter slightly smaller than the inner diameter of the internal sleeve part 254. The cylindrical body 262 has an inner chamber 265 which communicates with the water guide groove 257 of the sleeve 250 through a water inlet port 263. A plurality of orifices 266 are formed on front portion of the side wall of the body 262, thus ejecting pressurized water from the chamber 265 when the plunger 260 fully projects from the sleeve 250. The front end of the body 262 has a drain hole 265a, which communicates with the chamber 265 and allows a user to clean the chamber 265 or remove impurities from the chamber 265. A sealing screw 265*b*, with an O-ring, is screwed to the drain hole 265*a* in a way such that the screw 265*b* is loosened at the outside of the plunger 260.

The flange 264 of the plunger 260 has two guide protrusions 267 and 268 at the upper and lower ends, respectively. The upper guide protrusion 267 has a rectangular configuration and a size smaller than the sectional area of the upper guide groove 255 of the sleeve 250, thus being movably received in the guide groove 255. Meanwhile, the lower guide protrusion 268 has a triangular configuration and a size smaller than the sectional area of the lower guide groove 256 of the sleeve 250, thus being movably received in the guide groove 256.

The compression coil spring 270 is fitted over the internal sleeve part 254 and is stopped by the flange 264 of the plunger 260, so the spring 270 normally biases the plunger 260 in a retracting direction.

When pressurized water is supplied into the sleeve 250, the water pressure acts on the inside end of the plunger 260, thus pushing the plunger 260 while compressing the spring 270. The plunger 260 is thus projected from the outside of the sleeve 250. In such a case, the sliding action of the plunger 260 inside the sleeve 250 is smoothly performed by pressurized water which temporarily flows in the upper guide groove 255 of the sleeve 250 until the plunger 260 is fully projected from the sleeve 250. That is, the water, flowing in the upper guide groove 255, acts as a lubricant between the sleeve 250 and the plunger 260.

In the operation of the anal washing nozzle 240, pressurized water is not ejected from the orifices 266 of the plunger 260 until the plunger 260 is fully projected from the sleeve 250. That is, during a sliding movement of the plunger 260 inside the sleeve 250, the body 262 of the plunger 260 continuously closes the inside end of the water guide groove 257 of the sleeve 250 as shown in FIG. 8, so water is not introduced into the groove 257. However, when the plunger 260 is completely projected from the sleeve 250, the chamber 265 of the plunger 260 communicates with the rear chamber of the sleeve 250 through both the water guide groove 257 of the sleeve 250 and the water inlet port 263 of the plunger 260 as shown in FIG. 10. Therefore, pressurized water from the rear chamber of the sleeve 250 is ejected from the orifices 266 of the plunger 266.

When water supply for the anal washing unit 200 is stopped, the pressure in the sleeve 250 is reduced, thus allowing the plunger 260 to be elastically retracted into the sleeve 250 by the restoring force of the compression coil spring 270. During the retraction of the plunger 260, remaining water in the sleeve 250 is distributed to the outside of the sleeve 250 through the upper guide groove 255 while flushing the external surface of the plunger 260. It is thus possible to prevent any impurities or contaminated water from remaining in the gap between the sleeve 250 and the plunger 260.

Figure 12:
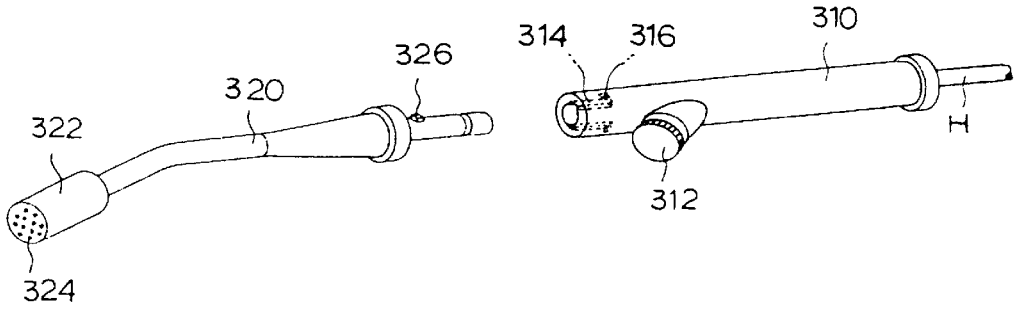
FIG. 12 is a perspective view of a pudendal washing unit of the above bidet.
Figure 13:
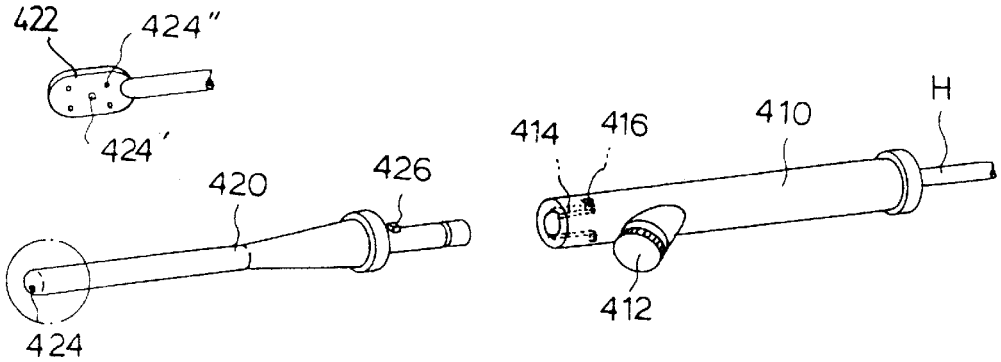
FIG. 13 is a perspective view of a mouth washing unit of the above bidet.

FIG. 12 is a perspective view of the pudendal washing unit 300. FIG. 13 is a perspective view of the mouth washing unit 400. As shown in the drawings, the general shape of the pudendal washing unit 300 remains the same as that of the mouth washing unit 400. That is, the two washing units 300 and 400 individually comprises a handle 310, 410 with a detachable tip 320, 420. A hose "H" is connected to the rear end of the handle 310, 410, while a nozzle body 322, 422 is provided at the outside end of the tip 320, 420.

In each of the two washing units 300 and 400, a finger-operable pressure control knob 312, 412 is provided on the handle 310, 410 in a way such that the knob 312, 412 is leaned forward at an angle of inclination, preferably, an angle of about 45°. That is, the knob 312, 412 is designed for allowing a user to easily operate the knob by a finger such as a thumb while gripping the handle 310, 410.

In the pudendal washing unit 300, the nozzle body 322 has a plurality of, preferably, twelve offices 324, thus spraying water onto a large area of one's bottom and improving the pudendal washing effect. In addition, the tip 320 of the unit 300 is appropriately bent at the middle portion at an obtuse angle, thus allowing a user, sitting on a toilet bowl, to conveniently wash one's pudendal region without overstraining one's wrist.

On the other hand, the nozzle body 422 of the mouth washing unit 400 may be provided with one orifice 424 which is formed by inclinedly perforating the outside end of the tip 420. Alternatively, the nozzle body 422 may be provided with one center orifice 424', having a large diameter, and four peripheral orifices 424" having a small diameter. In a brief description, the nozzle body 422 is designed for showering the oral cavity and massaging the gums. In addition, it is preferable to prepare several types of tips 420 which have different nozzle bodies 422 and are selectively used in accordance with an object to be washed.

In each of the pudendal and mouth washing units 300 and 400, the tip 320, 420 is designed for being attached to or removed from the handle 310, 410 by rotating the tip 320, 420 relative to the handle 310, 410. That is, a radial protrusion 326, 426 is formed on the shank of the tip 320, 420, while a guide groove' 314, 414 for the protrusion 326, 426 is axially formed on the coupling hole of the handle 310, 410. The inside end of the guide groove 314, 414 is terminated at a holding slot 316, 416 which seats the protrusion 326, 426 when the tip 320, 420 is completely coupled to the handle 310, 410.

Figure 14:
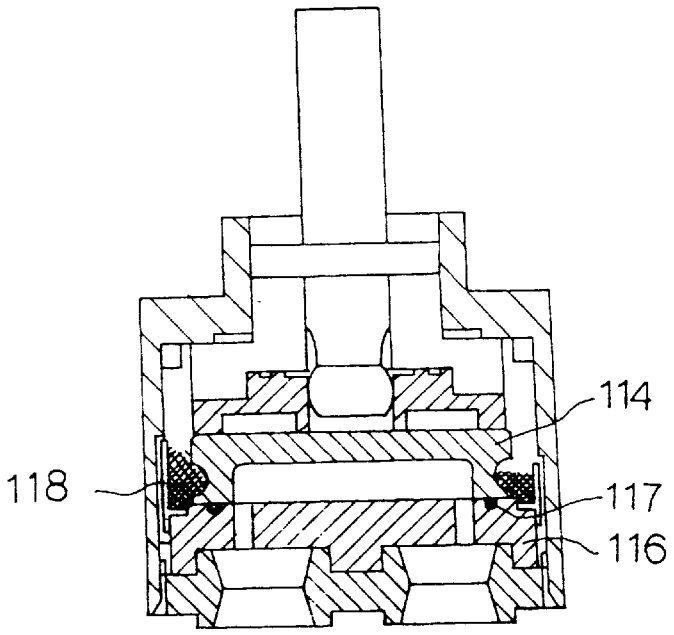
FIG. 14 is a sectional view showing the construction of a temperature control valve of the above bidet.

FIG. 14 is a sectional view showing the construction of the temperature control valve 110. As shown in the drawing, the general construction of the valve 110 remains the same as that of a conventional temperature control valve. That is, the valve 110 comprises a cap 114 seated on a circular base 116 with an oil fence 118 surrounding the base 116. However, different from the conventional temperature control valve, the valve 110 of this invention is provided with a sealing means for preventing leakage of grease from the junction between the cap 114 and the base 116. In order to form the sealing means, an annular oil groove 117 is formed on the top edge of a circular base 116 with the fence 118 being specifically designed as follows. That is, the fence 118 is partially heightened so as to compensate for the leaning position of the valve 110 on the control box 100. The sealing means effectively prevents operational error of the valve 110 due to leakage of grease from the junction between the cap 114 and the base 116.

Figure 15:
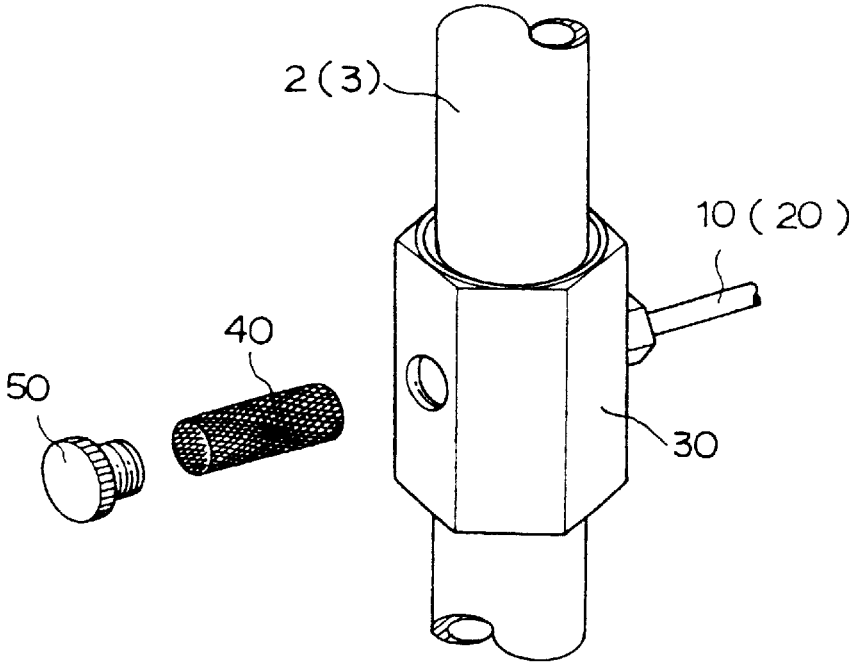
FIG. 15 is an exploded perspective view showing a pipe connector through which the hot or cold water supply hose is connected to the hot or cold water supply pipe.

FIG. 15 is an exploded perspective view showing a pipe connector 30 through which the hot or cold water supply hose 10, 20 is connected to the hot or cold water supply pipe 2, 3. As shown in the drawing, a filter 40, made of, for example, a stainless net, is installed in the pipe connector 30 and is held by a plug 50 which is screwed to the pipe connector 30. The above filter 40 filters water, supplied to the control box 100, thus preventing rust or impurities from being introduced into the control box 100.

The operational effect of the above bidet will be described hereinbelow.

In order to wash the anal region after excretion, a user, sitting on the toilet bowl 1, primarily pushes the flow control valve 120 down. Thereafter, the temperature control valve 110 is operated so as to appropriately control the temperature of water. Water, having an appropriate temperature, is supplied to the anal washing unit 200 from the temperature control valve 110. At the anal washing unit 200, water is introduced into the sleeve 250 of the anal washing nozzle 240, with the plunger 260 being fully retracted into the sleeve 250 by the compression coil spring 270.

When water is introduced into the sleeve 250 of the anal washing nozzle 240 as described above, the plunger 260 is pushed outwardly by the pressure of water acting on the flange 264 of the plunger 260. When the plunger 260 is fully projected from the sleeve 250 by the pressure of water, the inner chamber 265 of the plunger 260 communicates with the water guide groove 257 of the sleeve 250 through the water inlet port 263, so the nozzle 240 ejects pressurized water from the chamber 265 through the orifices 266, thus washing the anal region after excretion.

When water supply for the anal washing unit 200 is stopped by closing the temperature control valve 110, the pressure in the sleeve 250 is reduced, thus allowing the plunger 260 to be elastically retracted into the sleeve 250 by the restoring force of the compression coil spring 270. During the retraction of the plunger 260, remaining water in the sleeve 250 is distributed to the outside of the sleeve 250 through the upper guide groove 255 while flushing the external surface of the plunger 260. It is thus possible to prevent an impurities or contaminated water from remaining in the gap between the sleeve 250 and the plunger 260 and allow the smooth movement of the plunger 260 in the sleeve 250.

In order to wash the pudendal region after excretion, a user, sitting on the toilet bowl 1, primarily pulls the flow control valve 120 up. Thereafter, the temperature control valve 110 is operated so as to appropriately control the temperature of water in the same manner as that described for the anal washing operation. The user grips the handle 310 of the pudendal washing unit 300 in a way such that the nozzle body 322 of the tip 320 is directed toward the pudendal region. Thereafter, the finger-operable pressure control knob 312 is operated, thus ejecting pressurized water onto the pudendal region through the nozzle body 322. During such a pudendal washing operation, the user, sitting on the toilet bowl 1 and gripping the handle 310, easily and conveniently operates the control knob 312 using a finger, for example, a thumb, and effectively washes the pudendal region while freely changing the region to be washed.

In order to wash the oral cavity, both the flow control valve 120 and the temperature control valve 110 are operated in the same manner as that described for the pudendal washing operation. Thereafter, a user, gripping the handle 410 of the mouth washing unit 400, operates the finger-operable pressure control knob 412, thus ejecting pressurized water through the nozzle body 422. It is thus possible to shower the oral cavity and massage the gums. During the mouth washing operation, several types of tips 420, with different nozzle bodies 422, are selectively used in accordance with an object to be washed.

Figure 16:
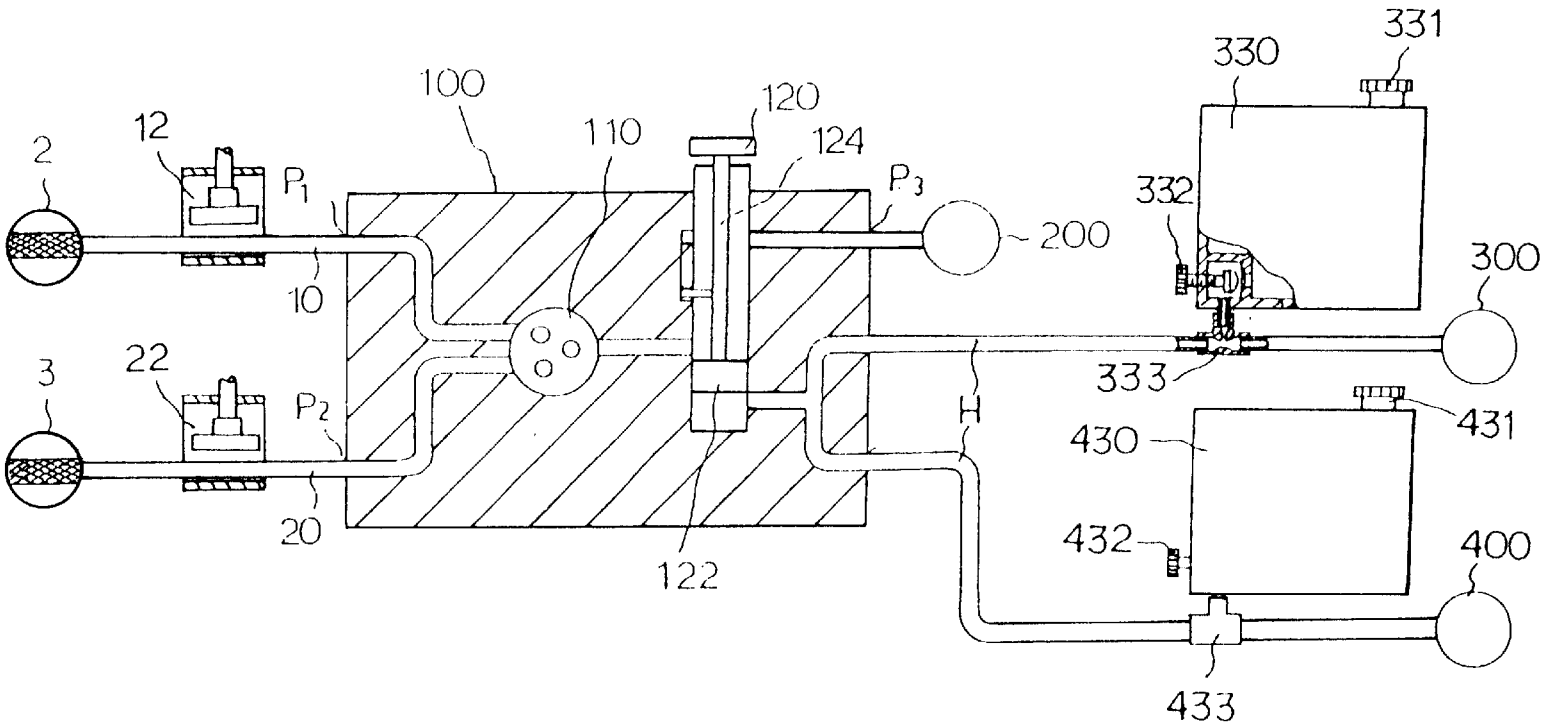
FIG. 16 is a view showing the construction of a bidet with a container for storing brine or liquid cleaning material in accordance with the second embodiment of the present invention.
Figure 17:
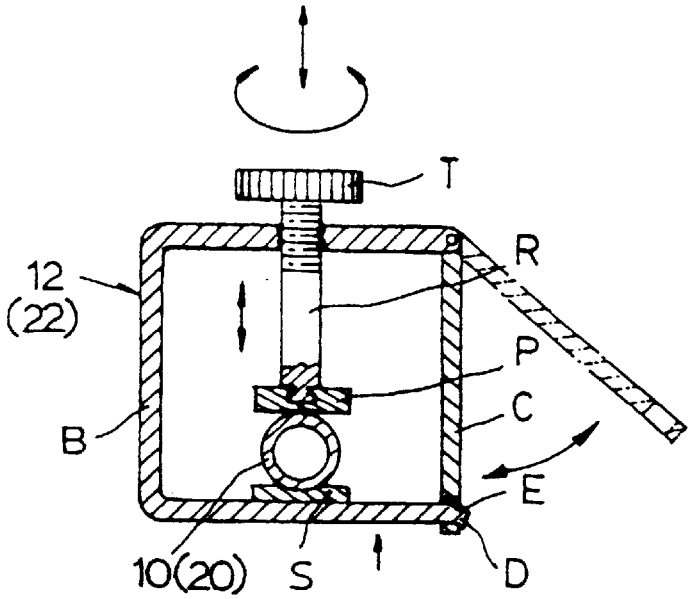
FIG. 17 is a sectional view showing the construction of a hot or cold water supply hose with a means for selectively changing the sectional area of the hose in accordance with the third embodiment of the present invention.
Figure 18:
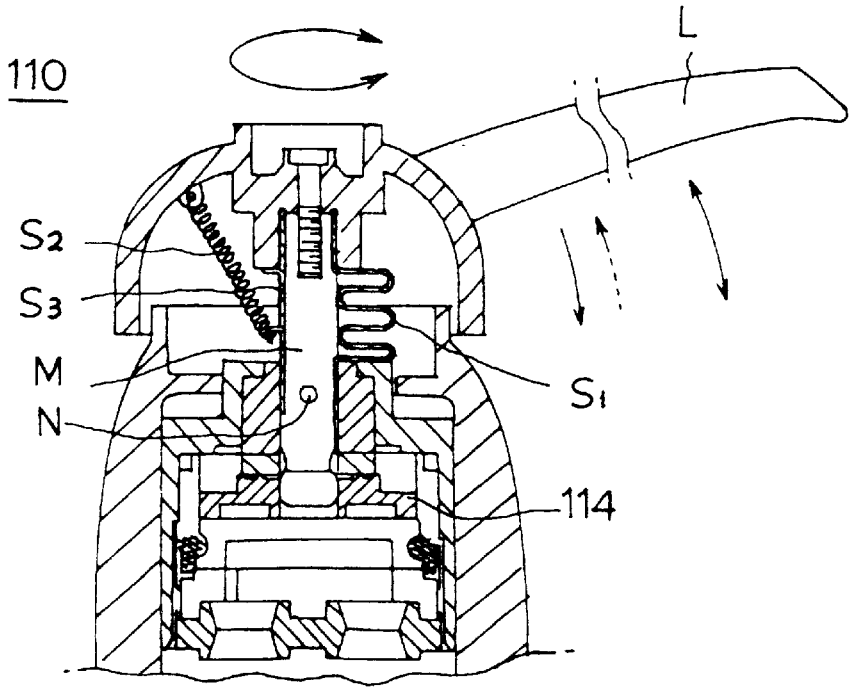
FIG. 18 is a sectional view showing the construction of a temperature control valve in accordance with the fourth embodiment of the present invention.

FIGS. 16 to 18 are views showing the construction and operation of bidets in accordance with the second to fourth embodiments of the present invention. In each of the embodiments, the general shape of the bidet remains the same as that described for the primary embodiment. However, in the bidet according to the second embodiment, each of the hot and cold water supply hoses is provided with a control means for selectively changing the sectional area of the supply hose at the outside of the hose so as to control the amount of water passing through the hose. In the third embodiment, the hoses for the pudendal and mouth washing units are individually provided with a container for storing brine or liquid cleaning material, thus allowing brine or liquid cleaning material to be ejected from the nozzle body along with water. Meanwhile, the temperature control valve according to the fourth embodiment is provided with re turn springs for allowing the control lever of the valve to be slowly returned to its original position when an external force is removed from the lever. The above return springs thus allow an appropriate amount of water to be supplied to the anal, pudendal and mouth washing units during the returning action of the lever.

As shown in FIG. 17, the control means, used for selectively changing the sectional area of each water supply hose 10, 20 according to the second embodiment, comprises a housing "B", which has a rectangular cross-section and is opened at both ends, and surrounds the hose 10, 20. A seat "S" is interiorly fixed to the bottom wall of the housing "B" and seats the hose 10, 20 thereon. A pressure member "P" is positioned on the hose 10, 20. thus selectively pressing the hose 10, 20 so as to change the sectional area of the hose 10, 20. A control knob "T" is positioned at the outside of the housing "B" and is connected to the press member "P" through a screw rod "R", so the knob "T" is handled outside the housing "B" so as to operate the press member "P". The screw rod "R" engages with an internally-threaded hole of the top wall of the housing "B".

One side wall of the above housing "C" is hinged to the top wall of the housing "B", thus allowing the water supply hose 10, 20, which is connected to the hose "H" for the pudendal or mouth washing unit 300, 400, to be installed in the housing "B". The free edge of the hinged side wall is provided with at least one engaging hole "E" which is brought into elastic engagement with an engaging protrusion "D" formed on the bottom wall of the housing "B". The engaging protrusion "D" is bent outwardly and downwardly, so the protrusion "D" is prevented from being unexpectedly removed from the engaging hole "E" irrespective of the tightening force applied to the housing "B" from the control knob "T" when the knob "T" is tightened so as to press the hose 10, 20.

On the other hand, each of the containers 330 and 430, used for adding brine or liquid cleaning material to water for the pudendal or mouth washing unit 300, 400 according to the third embodiment, is provided with an inlet port 331, 431 at its top wall. The container 330, 430 is also provided, at the lower portion, with a control valve 332, 432 for controlling the amount of brine or liquid cleaning material supplied to the washing unit 300, 400. A T-shaped pipe joint 333, 433, having a Venturi tube-type cross-section, is connected between the outlet end of each control valve 332, 432 and the hose "H" for a washing unit 300, 400. When water from the flow control valve 120 passes through the T-shaped pipe joint 333, 433, brine or liquid cleaning material from the container 330, 430 is added to water due to a pressure reduction at the small diameter portion of the joint 333, 433.

FIG. 18 shows the construction and operation of the temperature control valve 110 according to the fourth embodiment. As shown in the drawing, the temperature control valve 110 according to the fourth embodiment is designed for supplying water for a predetermined time prior to automatically stopping the water supply operation through a one-touch motion of a user. That is, a lever "L" is coupled to the top of the valve 110, while a shaft "N" connects the lever "L" to the cap 114 of the valve 110. When the lever "L" is pushed downwardly, the shaft "M" is rotated in a horizontal direction and a vertical direction around a pin "N", thus mixing hot and cold water together and controlling the temperature of water. A compression spring "S1" is vertically positioned along the shaft "M" at a side of the shaft "M" approximate to the lever "L", thus normally biasing the lever "L" upwardly. A coil spring "S2" is connected to the shaft "M" at a position opposite to the compression spring "S1", thus normally biasing the lever "L" to its original position. When an external force is removed from the lever "L", the lever "L" of the valve 110 is slowly returned to its original position for a time due to the restoring force of the two springs "S1" and "S2", thus allowing an appropriate amount of water to be supplied to the anal, pudendal and mouth washing units 200, 300 and 400 during the returning fiction of the lever "L".

The above compression spring "S1" is preferably formed by bending a longitudinal steel strip into a zigzag shape. Meanwhile, the coil spring "S2" is connected to the lever "L" and the shaft "M" at both ends. In such a case, the lower end of the coil spring "S2" is caught by a jawed fixing member "S3", such as a steel member, at a side of the shaft "M", thus elastically pulling the lever "L" upwardly when an external force is removed from the lever "L".

Industrial Applicability

As described above, the present invention provides a bidet, which is provided with separate units for washing one's anal region, pudendal region and oral cavity and allows a user to selectively wash the anal region, pudendal region and oral cavity using water. The bidet of this invention is used with existing hot and cold water supply pipes installed in a toilet, so it is not necessary for the bidet to be used with an electric hot-water supply system. This reduces the production cost and simplifies the construction of the bidet. The separate units of the above bidet do not use electricity but are effectively operated by water pressure. Particularly in the anal washing unit, the plunger of a nozzle is projected from or retracted into the sleeve by both the water pressure and the restoring force of springs, so the anal washing nozzle is almost free from malfunction. In addition, during a movement of the plunger inside the sleeve of the anal washing nozzle, remaining water in the sleeve is distributed to the outside of the sleeve through the gap between the sleeve and the plunger, thus flushing the external surface of the plunger and preventing any impurities or contaminated water from remaining in the gap between the sleeve and the plunger. In the operation of the anal washing unit, the nozzle only ejects water when the plunger is fully projected from the sleeve, so the nozzle is free from unexpectedly ejecting water onto one's bottom except for the anal region.

In the bidet of this invention, the pudendal and mouth washing units are not fixed but are designed for being hand-operated, thus being convenient to users. Particularly, the pudendal washing unit ejects water in a direction from the pudendal region to the anal region, thus improving the hygienic effect.

In addition, a pipe connector, through which the hot or cold water supply hose is connected to the hot or cold water supply pipe, is provided with a filter for preventing rust or impurities of water from being introduced into a control box, thus preventing the control box from malfunction. In the above bidet, the pressure of water is primarily controlled by the hot and cold water control valves and is secondarily controlled by the temperature control valve which is also used for controlling the temperature of water. Therefore, it is easy to control the pressure and temperature of water, so the bidet removes any inconvenience due to exceedingly high or low pressure or temperature of water, thus being convenient to users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bidet, comprising:

a control box attached to a side portion of a toilet bowl and used for controlling the bidet;

an anal washing unit positioned inside a rear portion of the toilet bowl and connected to said control box;

a hand-operated pudendal washing unit movably held on a front portion of said control box and connected to said control box through a hose; and a hand-operated mouth washing unit connected to said control box through a hose capable of allowing the mouth washing unit to reach a desired position remote from said toilet bowl.

2. The bidet according to claim 1, wherein said control box comprises:

a housing:

hot and cold water control valves respectively mounted to hot and cold water supply hoses extending into the housing;

a temperature control valve connected to outlet ends of said hot and cold water control valves at its inlet port, thus controlling water temperature by mixing hot and cold water from the two water control valves; and a flow control valve connected to an outlet port of said temperature control valve, thus controllably guiding water to the three washing units.

3. The bidet according to claim 2, wherein said hot and cold water supply hoses are connected to an electric hot-water supply system or existing hot and cold wash supply pipes installed in a toilet.

4. The bidet according to claim 2, wherein said flow control valve comprises:

a longitudinal valve rod movably set in a valve hole of said housing, said valve rod having both a hand-operated knob at the outside of the housing and an actuating protrusion radially outwardly formed on the valve rod inside the housing; and a guide slot formed on the valve hole of the housing and provided with upper and lower inclined s for selectively seating and holding the actuating protrusion of the valve rod.

5. The bidet according to claim 2, wherein said temperature control valve comprises:

a lever provided at a top end of said temperature control valve;

a shaft connecting the lever to a cap of the valve;

a compression spring vertically positioned along said shaft at a side of the shaft approximate to the lever, thus normally biasing the lever upwardly; and a coil spring connected to said shaft at a position opposite to the compression spring, thus normally biasing the lever to its original position.

6. The bidet according to claim 2, wherein said control box has a rectangular cross-section at a rear portion, thus forming a cavity suitable for accommodating the hot and cold water control valves, and a pentagonal cross-section at a front portion, thus effectively holding the temperature control valve at a position inclined outwardly and downwardly at an angle of about 30°~45° and is provided, at a front end, with a longitudinal hanger and an annular hanger both being used for hanging the pudendal washing unit.

7. The bidet according to claim 2, further comprising control means used for selectively changing a sectional area of each of the hot and cold water supply hoses, said control means comprising:

a housing having a rectangular cross-section and opened at both ends, of which having one side wall hinged to the top wall, and surrounding each of the houses;

a seat interiorly fixed to a bottom wall of said housing and seating the hose thereon;

a pressure member positioned on the hose, thus selectively pressing the hose so as to change the sectional area of the rose; and a control knob positioned fit the outside of the housing and connected to the press member through a screw rod engaging with an internally-threaded hole of a top wall of said housing, said control knob being thus handled outside the housing.

8. The bidet according to claim 2, wherein said temperature control valve comprises:

a cap seated on a circular base with sealing means being used for preventing leakage of grease from the junction between the cap and the base, said sealing means comprising:

an annular oil groove formed on a top edge of said circular base; and an oil fence surrounding the circular base, said fence being partially heightened so as to compensate for a leaning position of the temperature control valve on the control box.

9. The bidet according to claim 2, wherein a filter, having a fine net structure, is installed in a pipe connector between each of said hot and cold water supply hoses and an associated one of the hot and cold water supply pipes.

10. The bidet according to claim 1, wherein said control box is installed on the toilet bowl using two bracket members, thus being positioned outside a bowl's side wall, said two bracket members individually comprising:

an outside bracket having an L-shaped cross-section and laid across a wide top edge of the bowl and inserted into a bracket hole of the control box at its horizontal part prior to being screwed to the control box using a set bolt, said outside bracket having a longitudinal hole at the horizontal part, thus allowing a user to adjust the horizontal length of the outside bracket, and a plurality of holes at regularly spaced positions along the length of a vertical part;

an inside bracket positioned under the top edge of the bowl and coupled to one of the holes formed on the vertical part of the outside bracket; and a bolt vertically passing through the two brackets at the inside of the bowl prior to being tightened by a nut, thus fastening the two brackets together.

11. The bidet according to claim 1, wherein said anal washing unit comprises:

an anal washing nozzle;

an upper mount panel having two T-shaped fitting cutouts at its rear edge and a length adjustable connecting arm at its front edge, said upper mount panel being mounted to the rear portion of the bowl at the two fitting cutouts;

a link joined to an outside end of the connecting arm at a first joint, thus being rotatable around the first joint; and a nozzle holder used for holding the anal washing nozzle, said nozzle holder being jointed to an outside end of said link at a second joint, thus being rotatable around the second joint.

12. The bidet according to claim 11, wherein said anal washing nozzle comprises:

a sleeve having:

an internal thread formed at a rear end of the sleeve and engaging with an external thread of a screw plug;

an internal sleeve part provided in the sleeve with a gap being formed outside the internal sleeve part;

upper and lower axial guide grooves respectively formed at upper and lower internal surfaces of the sleeve at a rear portion; and an axial water guide groove formed at the lower internal surface of the sleeve at a front portion;

a plunger movably fitted into said internal sleeve part, said plunger comprising a cylindrical body having a flange at its rear end, said cylindrical body having:

an inner chamber selectively communicating with the axial water guide groove of the sleeve through a water inlet port when the plunger is fully projected from the sleeve:

a plurality of orifices formed on a front portion of the cylindrical body so as to communicate with said inner chamber; and two guide protrusions respectively formed at upper and lower ends of said flange and movably received in the upper and lower axial guide grooves of the sleeve;

a compression coil spring set in the gap outside the internal sleeve part of said sleeve, normal biasing the plunger in a retracting direction; and a screwed drain hole formed on the front of the body.

13. The bidet according to claim 1, further comprising two containers respectively mounted to hoses for the pudendal and mouth washing units and used for adding brine or liquid cleaning material to water for the pudendal and mouth washing units, each of said containers comprising:

a container control valve used for controlling the amount of brine or liquid cleaning material supplied to an associated washing unit; and a T-shaped pipe joint having a Venturi tube-type cross-section and connected between an outlet end of said container control valve and the hose for an associated washing unit.

14. The bidet according to claim 1, wherein each of said pudendal and mouth washing units comprises:

a handle;

a detachable tip removably mounted to the handle and having a nozzle body at its outside end; and a finger-operable pressure control knob provided on said handle, said pressure control knob being leaned forward at an angle of inclination.

* * * * *